US007131827B2

(12) United States Patent
Jäger et al.

(10) Patent No.: US 7,131,827 B2
(45) Date of Patent: Nov. 7, 2006

(54) STATOR FOR AN ECCENTRIC SCREW PUMP OR AN ECCENTRIC WORM MOTOR OPERATING ON THE MOINEAU PRINCIPLE

(75) Inventors: Sebastian Jäger, Hannover (DE); Reiner Kramer, Burgdorf (DE)

(73) Assignee: Artemis Kautschuk-und Kunststoff-Technik GmbH (DE)

( * ) Notice: Subject to any disclaimer, the term of this patent is extended or adjusted under 35 U.S.C. 154(b) by 94 days.

(21) Appl. No.: 10/714,812

(22) Filed: Nov. 17, 2003

(65) Prior Publication Data

US 2005/0106052 A1 May 19, 2005

(51) Int. Cl.
*F01C 1/10* (2006.01)
*F03C 2/00* (2006.01)
*F04C 18/00* (2006.01)

(52) U.S. Cl. ..... 418/48; 418/153; 418/178; 415/72; 415/73; 366/51; 138/138; 138/139; 166/236

(58) Field of Classification Search ..... 418/48, 418/153, 178; 415/72, 73, 76; 416/176, 416/177; 366/51; 138/138, 139, 143, DIG. 11; 166/236, 105; 175/107
See application file for complete search history.

(56) References Cited

U.S. PATENT DOCUMENTS 2,700,936 A * 2/1955 Sackett ..... 415/72
2,862,454 A * 12/1958 Alcock ..... 418/48
3,139,035 A * 6/1964 O'Connor ..... 418/48
3,300,811 A * 1/1967 Berger ..... 415/72
3,435,772 A * 4/1969 Schlecht ..... 418/48
5,171,139 A * 12/1992 Underwood et al. ..... 418/48

FOREIGN PATENT DOCUMENTS

DE 2541779 A * 3/1977
DE 4403598 A1 * 8/1995
JP 61180512 A * 8/1986

* cited by examiner

*Primary Examiner*—Theresa Trieu

(57) ABSTRACT

The invention relates to a stator for an eccentric screw pump or an eccentric worm motor, including an outer tube that is provided with a lining of rubber or a rubber-like material and has a hollow space or cavity, in the shape of a double or multiple spiral, for accommodating a rigid rotor that is also in the form of a spiral, whereby the stator has one spiral more than does the motor. So that the stator also remains functional under conditions where the fixed connection between the lining and the outer tube could be destroyed, e.g. due to chemical influences or high temperatures, the invention proposes disposing two inner tubes that have apertures in the lining.

8 Claims, 4 Drawing Sheets

STATOR FOR AN ECCENTRIC SCREW PUMP OR AN ECCENTRIC WORM MOTOR OPERATING ON THE MOINEAU PRINCIPLE

BACKGROUND OF THE INVENTION

The invention relates to a stator for an eccentric screw pump or an eccentric worm motor, and includes an outer tube that is provided with a lining of rubber or a rubber-like material and has a hollow space or cavity, in the shape of a double or multiple spiral, for accommodating a rigid rotor that is also in the form of a spiral, whereby the stator respectively has one spiral more than does the rotor.

The manner of operation of eccentric screw pumps and eccentric worm motors is also designated as the Moineau principle. From DE 44 03 598 A1 a stator of the aforementioned type is known according to which the lining is fixedly connected with the outer tube, i.e. via chemical bonding between the elastomeric lining and a metallic outer tube. The outer tube of this stator has a cylindrical shape. However, stators are also known according to which the shape of the outer tube is adapted to the shape of the hollow space or cavity surrounded by the lining such that the thickness of the lining, in other words the spacing between the hollow space and the outer tube, is continuously the same or nearly the same. With both embodiments of the previously known stators there exists the danger that the fixed connection between lining and outer tube becomes detached, primarily if during the operation the stator is subjected to high temperatures and/or chemical stresses. Even if the lining can withstand these stresses, a detachment from the outer tube occurs if a bonding agent is used that cannot withstand either the thermal and/or the chemical conditions.

There are rubber types, such as HNBR fluoro rubbers or silicone rubbers, which at temperatures of 160° C. and greater remain functional, yet even with these rubbers the rubber/metal connection can become problematic and can be destroyed during continuous use.

It is an object of the invention to provide a stator that remains functional even under those conditions where the fixed connection between the lining and the outer tube could be destroyed, e.g. by chemical influences or high temperatures.

SUMMARY OF THE INVENTION

To realize this object, pursuant to the invention two tubes having apertures are disposed in the lining.

A mechanical interlocking, i.e. a positive connection, results between the rubber layer and the tubes that have the apertures. The tubes that have the apertures thus effect the connection between the outer tube and the lining. The tubes having the apertures are preferably made of metal.

Pursuant to the invention, the stator is provided with two apertured inner tubes that are inserted into one another and have very different aperture diameters. This has the advantage that hollow spaces result that produce rubber-filled undercuts. A radial displacement of the lining when subjected to stress is thereby effectively prevented.

The inner tube of the two tubes that have the apertures is, during introduction of the lining, of course more surrounded by this lining than is the inner tube that is disposed closer to the outer tube. The last mentioned tube functions quasi as a spacer and has the objective of ensuring a minimal spacing between the inner tube that has apertures and the outer tube. The lining can completely or nearly completely surround the inner tube. The lining additionally has contact with the outer tube, namely by and through the apertures with which the middle tube is provided.

During the manufacture of the inventive stator, the rubberizing, i.e. the introduction of the elastomeric lining into the outer tube, can be effected without a bonding-enhancing pre-treatment of the metal surfaces, for example by use of a bonding agent. The rubberizing can, however, also be effected with the use of a chemical bonding system, e.g. an adhesive agent. Should the chemical bond between rubber and metal be destroyed during use due to the effect of chemicals, heat and/or by mechanical action, the mechanical interlocking nonetheless ensures the functioning of the stator.

BRIEF DESCRIPTION OF THE DRAWINGS

Further details of the invention will be explained with the aid of the drawings, which illustrate embodiments of the invention.

The drawings show.

DESCRIPTION OF SPECIFIC EMBODIMENTS

Figure 1:
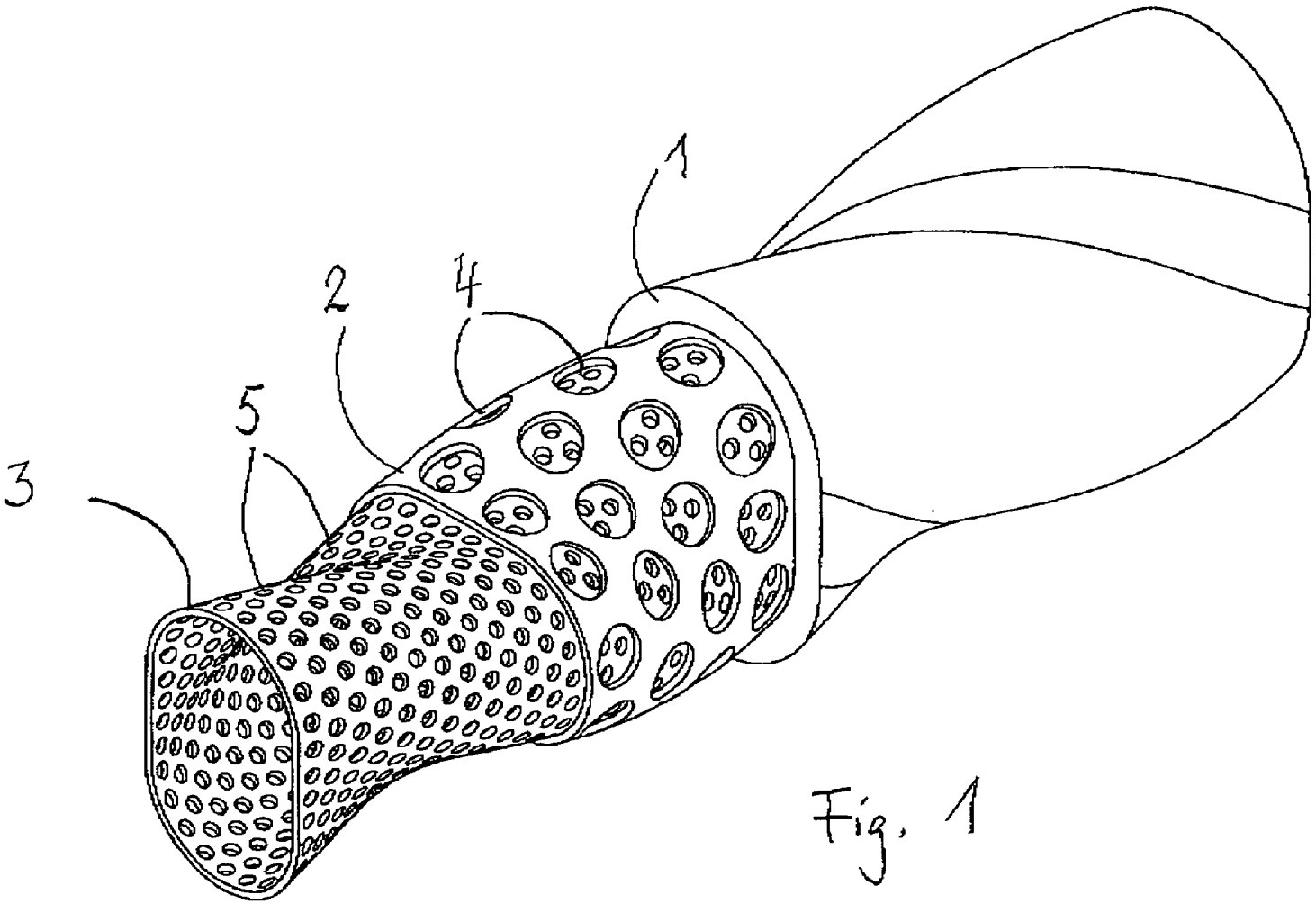
FIG. 1 a perspective illustration of one exemplary embodiment of the invention with partially exposed layers (without lining)

The stator illustrated in FIG. 1 is provided with an outer tube 1 of a solid material (e.g. steel), in the interior of which are disposed the inner tubes 2 and 3. The inner tube 2 that is disposed the closest to the outer tube 1 is provided with apertures 4.

The inner tube 3 is disposed in the inner tube 2. The lining 6 of the outer tube is not illustrated in FIG. 1.

In one advantageous embodiment of the invention, the apertures 4 of the inner tube 2, and the apertures 5 of the inner tube 3, have different sizes; in particular, the apertures 4 are larger. In this way, the elastomeric material of the lining can surround and extend through the inner tube 3 via the apertures 5, so that a particularly good adhesion results between the lining 6 and the inner tube 3 and to the outer tube 1. The inner tube 3 is nearly embedded in the elastomeric mass 6.

Figure 2:
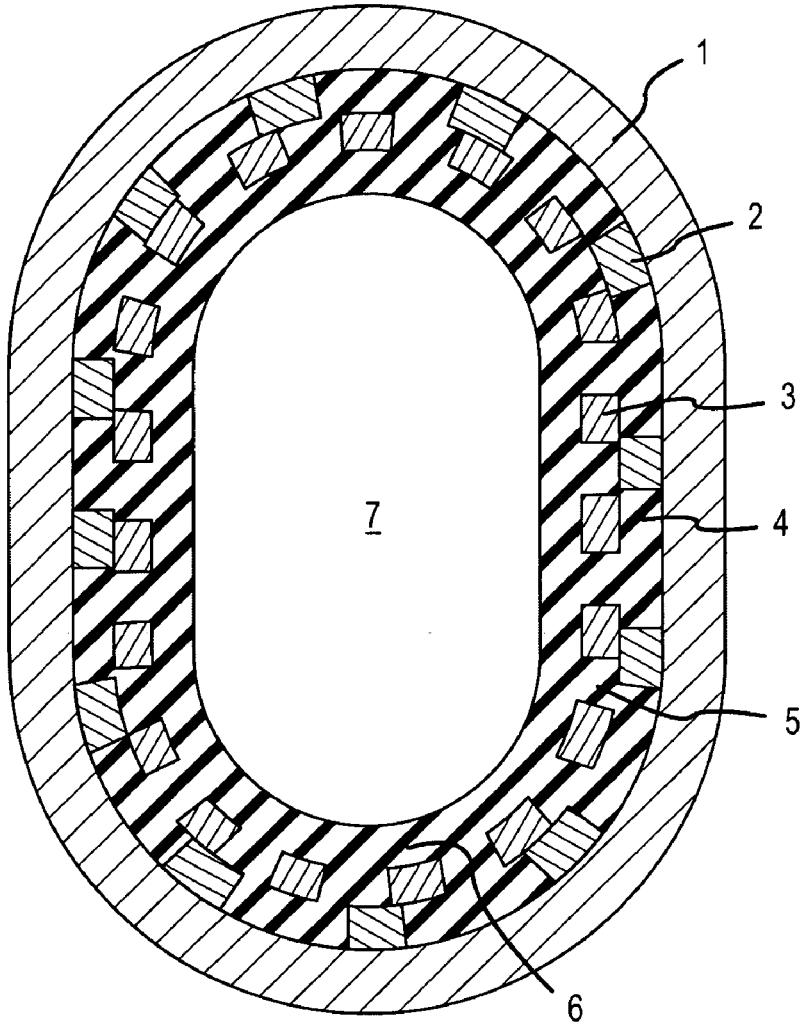
FIG. 2 a cross-sectional view through the stator of FIG. 1.

FIG. 2 illustrates a cross-section of a stator such as is formed in FIG. 1. Here also disposed in the outer tube 1 are the inner tubes 2 and 3, which are provided with the apertures 4 and 5 respectively. Furthermore, the lining 6 is illustrated in the outer tube 1. The lining 6 surrounds the passage or bore 7, which is here illustrated only crudely.

The bore 7 forms the space for accommodating the material that is to be conveyed (hollow space or cavity of pump), in the event that the stator is used with an eccentric screw pump, or the space for accommodating the flowing drive medium, in the event that the stator is part of a device used as a motor. The bore 7 extends over the entire length of the stator. It is wound with a double or multiple spiral, and serves for receiving a here not-illustrated rotor. The forces that occur during use of the pump are absorbed by the lining 6 and are conveyed onto the outer tube 1, by means of which the mounting of the pump is effected. A fixed connection between outer tube 1 and lining 6 must therefore be provided. Pursuant to the invention this occurs via the inner tubes 2 and 3.

The important thing is that disposed in the outer tube 1 are the inner tubes 2 and 3, which are provided with a perforation or a plurality of apertures 4 and 5 respectively. The apertures 4 and 5 are filled by the material of the lining 6. This results in a positive connection between the outer tube 1, the inner tubes 2 and 3, and the lining 6, so that the lining 6 is protected not only against displacement in the longitudinal direction but also against a rotation about its axis. A connection between outer tube and lining produced by vulcanization or adhesion can be eliminated. However, for the invention it is not mandatory that the adhesion or vulcanization be dispensed with.

As mentioned previously, the bore 7 is wound in a spiral manner. The outer tube 1 has a shape such that it extends parallel or nearly parallel to the outer contours of the bore 7. In this way, a uniform, at least nearly uniform, wall thickness of the lining 6 is achieved, which with certain applications has proven to be advantageous relative to stators having cylindrically shaped outer tubes.

The inner tubes 2 and 3 can be formed by conventional apertured plates or sheets that have been cylindrically curved. For the manufacture of an inventive stator, the inner tubes 2 and 3 are placed into the outer tube 1, and all of the tubes 1, 2 and 3 are brought into the desired spiral shape. However, it is also possible to initially separately form the tubes 1, 2 and 3 from one another in order to then join them together, for example by twisting the inner tubes 2 and 3 into the outer tube 1. The lining 6 can subsequently be introduced by spraying or injecting the rubber material.

Pursuant to an advantageous embodiment, the inner tube 2 can also comprise a hose of elastomeric material or the like, especially rubber. This non-illustrated hose is inserted over the inner tube 3. The inner tube 3 and the hose are then introduced into the outer tube 1. It is self understood that the hoses does the inner tube 2 can also be provided with apertures into which the elastomeric material of the lining 6 can flow.

In the event that the stator is produced entirely without a fixed connection between outer tube 1 and lining 6, although there results a mechanical, positive connection between the lining 6 and the inner tube 2, in contrast to stators having a chemical rubber/metal connection, it can none-the-less not be precluded that via a gap between the outer tube 1 and the lining 6 that a leak can result and hence lead to a drop in pressure between the intake side and the pressure side of the pump. This can be prevented by means of a clamping seal at the end faces of the lining 6. Two embodiments for such a clamping seal will be explained in the following with the aid of FIGS. 3 and 4.

Figure 3:
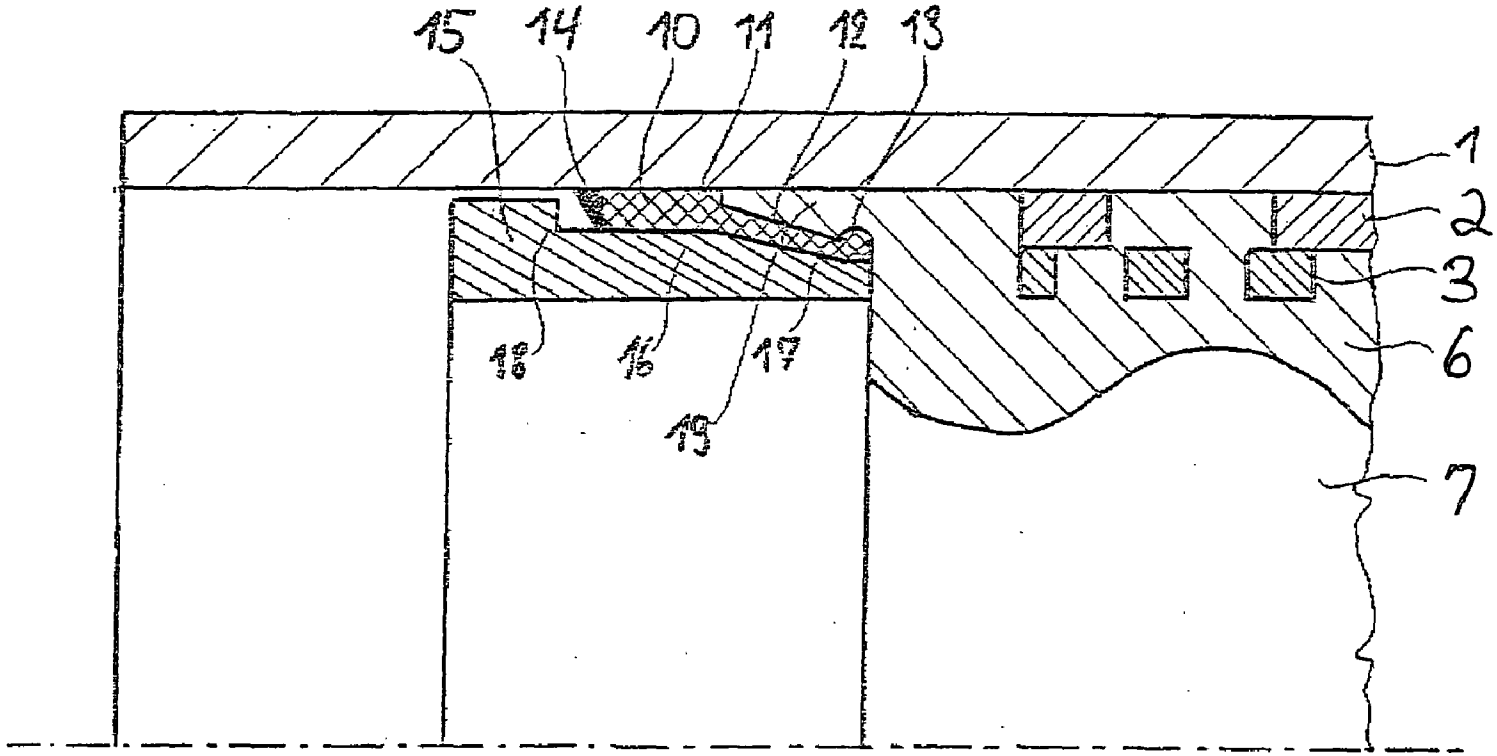
FIG. 3 a longitudinal cross-sectional view through the end portion of a further embodiment of the inventive stator.

With the embodiment of FIG. 3, provided on the end face of the lining 6 is a conical sealing ring 10, which has a cylindrical section 11, a conical section 12, and a sealing bead 13. The conical section 12 is spaced from the inner side of the outer tube 1 and is embodied in such a way that its spacing from the outer tube 1 increases in a direction toward the interior of the stator. The sealing ring 10 is connected with the outer tube 1 via a welding seam 14. However, the sealing ring 10 can also be connected with the outer tube 1 via a press fit rather than a weld connection.

Furthermore disposed at the sealing ring 10 is a clamping ring 15, which has a cylindrical section 15, a conical section 17, and an abutment 18.

During the manufacture of the stator, the sealing ring 10 is introduced into the outer tube 1, is positioned, and is possibly secured there before the material (rubber) of the lining 6 is introduced into the outer tube 1. After the introduction of the rubber, a conical annular gap 19 between the conical section 12 of the sealing ring 10 and the outer tube 1 is filled with rubber. Experience has shown that upon cooling, however, the rubber contracts not only away from the outer tube 1 but also away from the sealing ring 10. To close off the thereby resulting gap, and to sealingly compress the rubber in the annular gap 19 between the conical section 12 of the sealing ring 10 and the outer tube 1, the clamping ring 15 is pressed axially in. The thickness of the conical section 17 of the clamping ring 15 is greater than the thickness of the conical section 12 of the sealing ring 10. This ensures that the conical section 17 of the clamping ring 15 presses the conical section 12 of the sealing ring 10 outwardly. The sealing bead 13 of the sealing ring 10 prevents the rubber from slipping out of the annular gap 19 under conditions of use.

Figure 4:
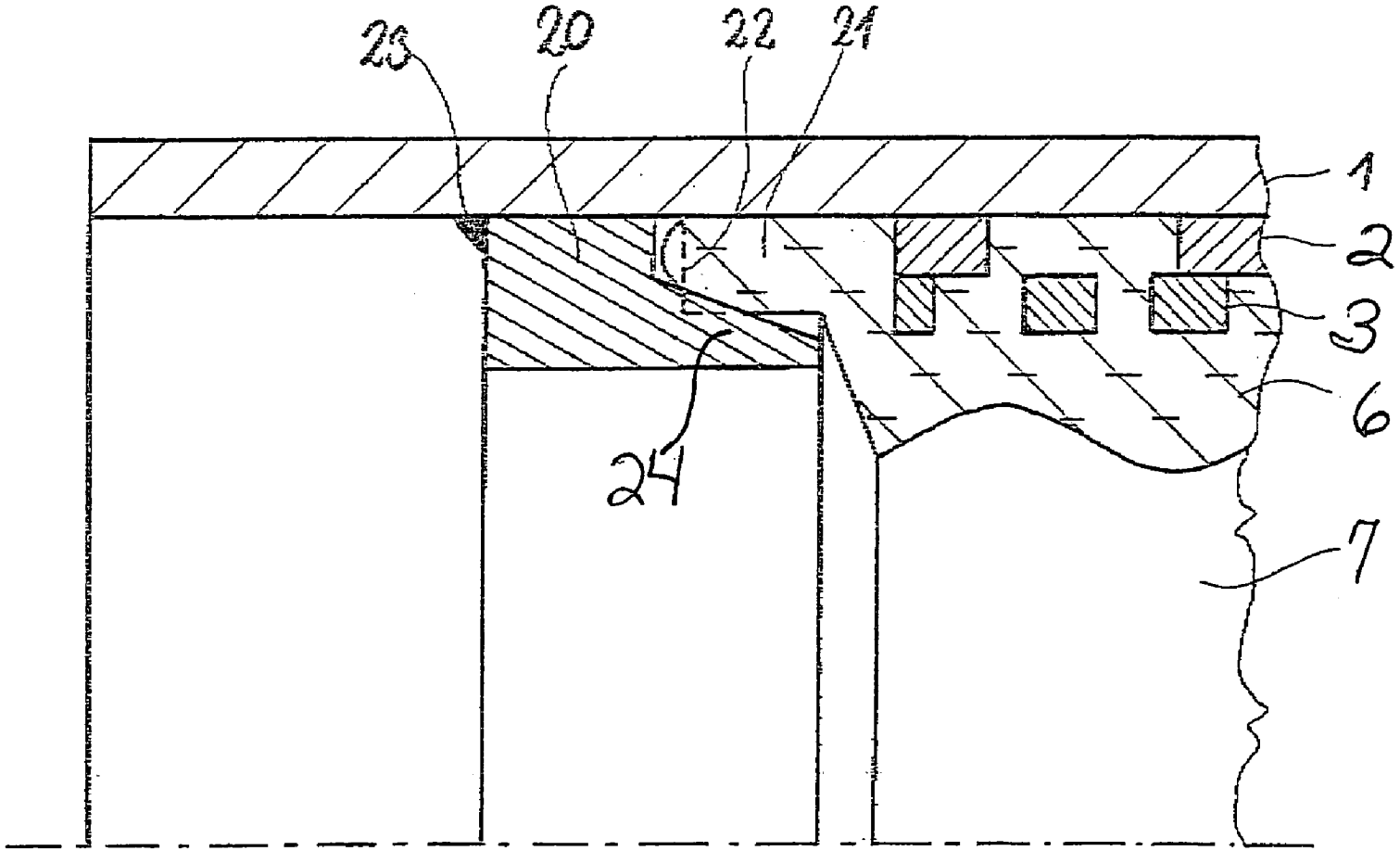
FIG. 4 a longitudinal cross-sectional view through the end portion of a further embodiment of the inventive stator.

With the embodiment of FIG. 4, a simple sealing ring 20 is provided at the end face of the lining. This sealing ring 20 is suitable for installation after the introduction of the lining 6 into the outer tube.

During the manufacture of the stator of FIG. 4, first the lining 6 of rubber or a similar material is connected with the tubes 1 and 2 via the injection process. In this connection, the end portion 21 of the lining 6 is shaped as illustrated, for example, by dashed lines at the reference numeral 22. In order to achieve a pressure tight seal that is free of gaps between outer tube 1 and lining 6, after the vulcanization of the lining 6 the sealing ring 20, which has a partial conical configuration, is pressed into the outer tube 1. In so doing, the end portion 21 of the lining 6 is compressed by the conical region 24 of the sealing ring 20 and is pressed firmly against the outer tube 1.

As illustrated at the reference numeral 23, the sealing ring 20 can be connected via a welding seam with the outer tube 1 to thereby be protected against axial displacement. Pursuant to another embodiment of the invention, the sealing ring 20 can also be protected against displacement via a press fit between sealing ring 20 and outer tube 1.

FIGS. 3 and 4 show possibilities for the sealing of the invention. It is to be understood that these seals can be utilized not only in such stators which, for example, have no spiral outer tube but rather a cylindrical outer tube, but also are suitable for spirally wound stators pursuant to FIGS. 1 and 2.

Pursuant to a here not-illustrated embodiment of the invention, the outer tube 1 can also be provided with apertures. It is not mandatory that the outer tube have a closed surface.

The invention claimed is:

1. A stator for an eccentric screw pump or an eccentric worm motor, comprising:

an outer tube that is provided with a lining of elastomeric material and has a hollow space or cavity, in the shape of a double or multiple spiral, for accommodating a rigid rotor that is also in the form of a spiral, wherein said stator has one spiral more than does said rotor, and wherein said outer tube has a configuration such that a thickness of said linings is at least nearly uniform; and two inner tubes disposed in said linings, wherein said inner tubes are respectively provided with apertures.

2. A stator according to claim 1, wherein said inner tubes are made of metal.

3. A stator according to claim 1, wherein a size and number of said apertures of said two inner tubes differ.

4. A stator according to claim 1, wherein a second one of said inner tubes is disposed in a first one of said inner tubes, wherein said apertures of said second inner tube have a smaller diameter than do said apertures of said first inner tube, and wherein said second inner tube is provided with a greater number of apertures than is said first inner tube.

5. A stator according to claim 1, wherein inner one of said inner tubes is surrounded by a hose of elastomeric material rather than by the other one of said inner tubes.

6. A stator according to claim 5, wherein said elastomeric material is rubber.

7. A stator according to claim 5, wherein said hose is provided with apertures.

8. A method for producing the stator of claim 1, including the steps of:

producing said outer tube and said inner tubes from cylindrical tubes;

fitting said outer tube and said inner tubes, together and then interconnecting them; and subsequently imparting said outer tube and said inner tubes.

* * * * *